United States Patent [19]

Yielding

[11] 4,255,069

[45] Mar. 10, 1981

[54] JACK-UP PLATFORM LOCKING APPARATUS

[75] Inventor: Ralph D. Yielding, Houston, Tex.

[73] Assignee: The Offshore Company, Houston, Tex.

[21] Appl. No.: 62,659

[22] Filed: Aug. 1, 1979 (Under 37 CFR 1.47)

[51] Int. Cl.[3] ..... E02B 17/08; B66F 1/00

[52] U.S. Cl. ..... 405/196; 254/105; 405/198

[58] Field of Search ..... 405/196, 197, 198, 199; 254/105-111; 24/263

[56] References Cited

U.S. PATENT DOCUMENTS

| | | | |
|---|---|---|---|
| 2,308,743 | 1/1943 | Bulkley et al. . | |
| 2,970,445 | 2/1961 | Suderow . | |
| 3,171,259 | 3/1965 | Roussel | 405/199 |
| 3,278,158 | 10/1966 | Saldana | 254/106 |
| 3,343,371 | 9/1967 | Heitkamp | 405/198 |
| 3,484,911 | 12/1969 | Smulders | 24/263 |
| 3,495,806 | 2/1970 | Sutton | 405/198 X |
| 3,722,863 | 3/1973 | Itoh et al. | 254/105 |
| 4,007,914 | 2/1977 | Sutton | 405/198 |

*Primary Examiner*—Dennis L. Taylor
*Attorney, Agent, or Firm*—Bradford E. Kile

[57] ABSTRACT

The invention relates to a jack-up platform locking apparatus. The subject locking apparatus includes a frame operable to be securely connected to a deck of the platform and a lock unit having at least one tooth for engaging a compatibly configured surface upon a vertically adjustable platform leg. Hydraulic motor means are provided for vertically adjusting the lock with respect to the deck and leg. An additional hydraulic motor is provided for horizontally actuating or deactuating the lock with respect to the platform leg. The invention further includes a mechanical assembly for vertically securing an engaged lock with respect to the platform deck. A reaction wedge member is provided for horizontally securing the lock in firm engagement with the leg of the offshore platform.

11 Claims, 6 Drawing Figures

JACK-UP PLATFORM LOCKING APPARATUS

BACKGROUND OF THE INVENTION

This invention relates to a jack-up platform locking apparatus. More specifically this invention relates to an apparatus for locking an offshore platform deck with respect to a vertically adjustable leg of the platform independently of a platform jack-up drive assembly.

In the past, offshore platforms or towers have been extensively utilized around and upon the continental shelf regions of the world. Examples of offshore platform installations include supports for radar stations, light beacons, scientific and exploration laboratories, chemical plants, power generating plants, etc. Principally, however, offshore platforms have been utilized by the oil and gas industry in connection with oil and gas drilling, production and/or distribution operations.

In conducting such offshore activity several platform designs have been utilized in the industry. In deep water applications, semi-submersible or floating drill ships which are dynamically positioned and/or turret moored over a well site have been effectively utilized. In shallower water applications fixed length towers have been fabricated on shore and either transported in a horizontal posture to an offshore site by barge or towed upon bouyancy chambers within the tower legs. On site the tower is pivoted into an upright posture and the base of the tower legs are positioned into firm engagement with the seabed. A platform deck is then fabricated upon the erected tower for conducting offshore operations. Such fixed platforms require considerable time to assemble and once in position are difficult to relocate.

One platform design which combines many of the advantages of floating and fixed equipment is known as a "jack-up platform". In this connection a barge or self-propelled deck, operable to function in a conventional flotation capacity during transportation, is fitted with extendable legs which are deployable on site. More specifically, the hull/deck carrying one or more jack-up legs is either towed or navigated to a desired offshore site and the legs are jacked through wells in the deck into firm supporting engagement with the water bed. Further jacking serves to raise the deck with respect to the surface of the body of water and once the lowermost portion of the deck is positioned above a statistical wavecrest height jacking is discontinued and drilling and/or production operations are begun.

The subject invention is directed to a deck locking apparatus for a jack-up platform such as previously described.

Various designs have been advantageously utilized to jack the supporting legs with respect to the platform deck. One such design comprises a jacking mechanism having hydraulic cylinders which reciprocate vertically along the legs of the offshore tower and carry horizontally actuatable pins at the ends thereof for engagement with apertures positioned within rails affixed to the legs. Another previously known jacking mechanism comprises one or more racks which longitudinally extend along the operative jacking length of the offshore tower legs. Pinion gears mesh with the leg mounted racks and are driven by hydraulic or electric drive assemblies mounted upon the platform deck.

Although jack-up platform designs have attained a considerable degree of commercial acceptance, at least some jack-up mechanisms, and particularly the jack-up mechanisms of the rack and pinion type, permit a degree of undesireable slack or vertical mobility between the legs and platform. Such mobility may prove to be disadvantageous when the platform encounters environmental hydrodynamic and aerodynamic loading. More specifically platform legs typically comprise a set of three or more vertical chords which are interconnected and strengthened with "K" or "X" type bracing. As previously mentioned the legs extend through wells fashioned within the platform deck and peripherally pass adjacent bearing surfaces at the upper and lower surface of the deck. Tolerance within some jack-up mechanisms, combined with bending moments encountered from environmental loading, tends to displace the legs into abutting lateral contact with the upper and lower surfaces of the deck. Accordingly typical platform legs must be overdesigned to carry lateral reaction forces at locations intermediate the junctions of the "K" or "X" type bracing.

In a similar vein present jack-up systems are fabricated with large structural members in order to withstand and react against environmentally imposed moments. The structural size of these members needed to safely react peak statistical moments adds a considerable degree of dead weight and cost to the overall platform design.

The difficulties suggested in the preceding are not intended to be exhaustive, but rather among many which may tend to reduce the effectiveness and owner satisfaction of prior jack-up offshore platform systems. Other noteworthy problems may also exist; however, those presented above should be sufficient to demonstrate that jack-up platform systems particularly of the rack and pinion type appearing in the past will admit to worth-while improvement.

OBJECTS OF THE INVENTION

It is therefore a general object of the invention to provide a novel, jack-up platform locking apparatus which will obviate or minimize difficulties of the type previously described.

It is a specific object of the invention to provide a novel jack-up platform locking apparatus wherein the platform deck may be securely connected to the platform legs in a raised position independent of the platform jacking assemblies.

It is another object of the invention to provide a novel jack-up platform locking apparatus wherein environmentally imposed moments upon the jack-up legs may be reacted at secure design locations and not through deck well guides.

It is a further object of the invention to provide a novel jack-up platform locking apparatus which will enable the structural dead weight of the platform to be reduced while maintaining statistical safety standards for environmentally imposed bending moments.

It is yet another object of the invention to provide a novel jack-up platform locking apparatus which may be vertically adjusted with respect to the deck and platform leg.

It is still another object of the invention to provide a novel jack-up platform locking apparatus wherein a locking mechanism may be horizontally actuated into engagement with the platform legs and securely retained in substantial load bearing engagement.

It is a further object of the invention to provide a novel jack-up platform locking apparatus wherein the locking assembly may be mechanically secured in a vertical posture following a vertical adjustment procedure.

It is yet a further object of the invention to provide a novel jack-up platform locking apparatus which is composed of rugged components which may be facilely manufactured and economically and reliably produced to form a highly reliable long-term locking assembly suitable for use in an adverse environment.

BRIEF SUMMARY OF A PREFERRED EMBODIMENT OF THE INVENTION

A preferred embodiment of the invention which is intended to accomplish at least some of the foregoing objects comprises a jack-up platform locking apparatus for securing a vertically adjustable leg of an offshore platform with respect to a deck of the platform. The locking apparatus includes a frame which is operable to be securely connected to the deck of the offshore platform. The frame carries a locking assembly having at least one tooth compatibly configured with a reciprocal surface on the leg. The locking assembly is vertically adjustable with respect to the deck and leg through the provision of a hydraulic motor positioned operably between the deck and the lock mechanism. Horizontal actuation and deactuation of the lock is provided by another hydraulic motor which is operably connected between the deck and a back portion of the lock. Once the lock is vertically positioned and horizontally engaged a mechanical securing system firmly holds the locking member in a secure vertical position. Finally, the subject invention preferably includes a locking wedge operable to engage a sloping surface on the back side of the locking member and retain the member in an engaged posture.

THE DRAWINGS

Other objects and advantages of the present invention will become apparent from the following detailed description of a preferred embodiment thereof taken in conjunction with the accompanying drawings, wherein.

Figure 6:
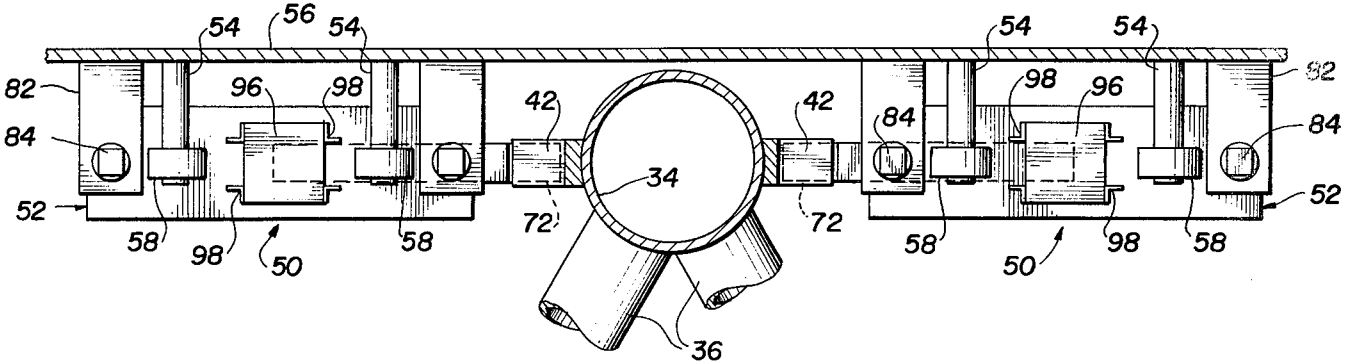
Figure 5:
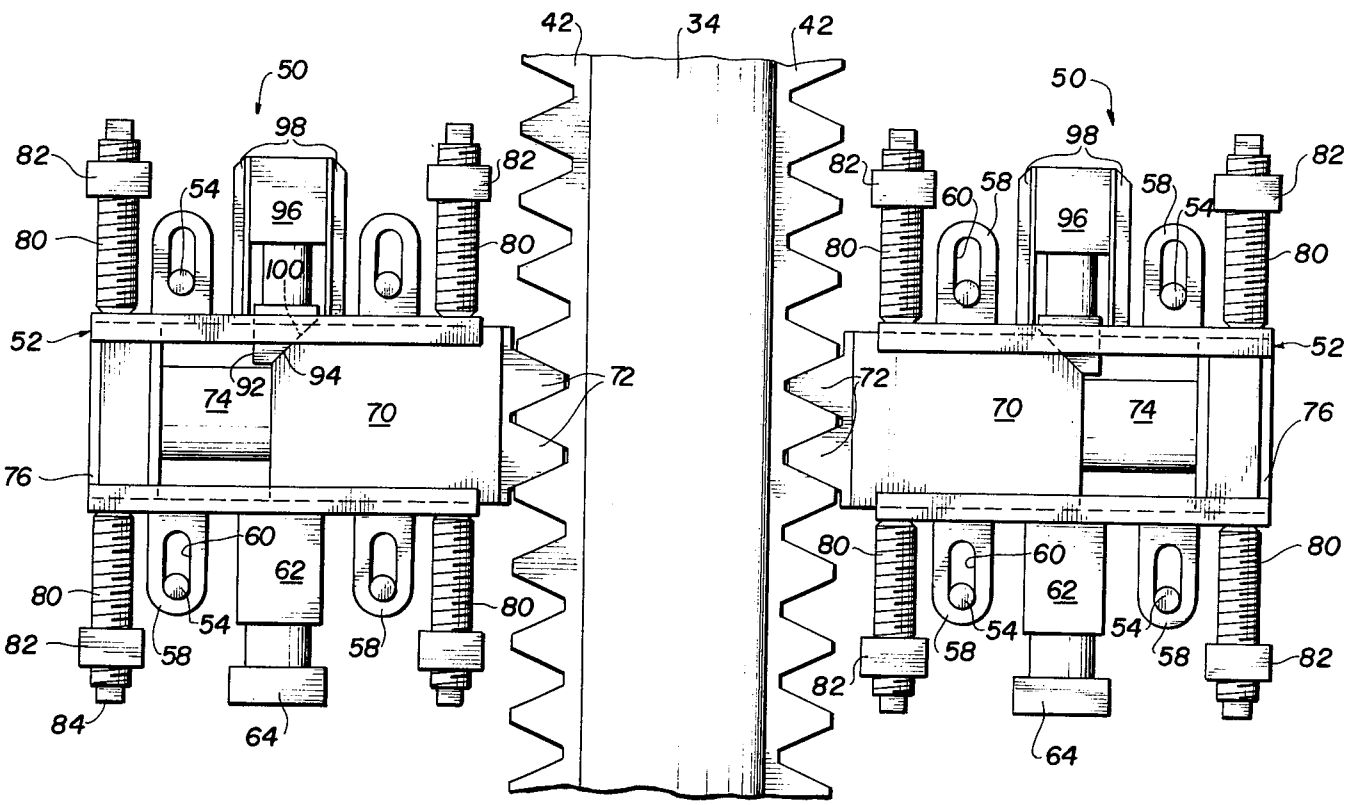

FIG. 5, note sheet four, is a plan view of the subject locking apparatus wherein the chock is actuated into an engaged and locked posture with respect to racks extending upon either side of a platform leg chord; and FIG. 6, note sheet three, is a plan view of the subject locking apparatus depicted in FIG. 5 in an engaged posture.

DETAILED DESCRIPTION

Context of the Invention

Figure 1:
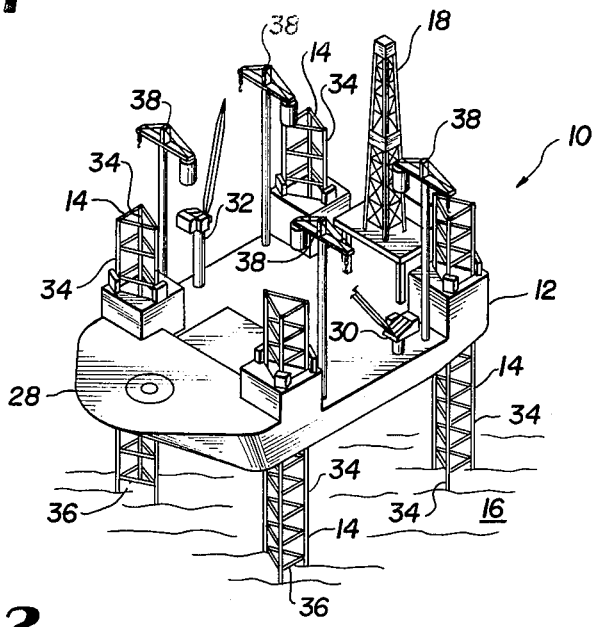
FIG. 1 is an axonometric view of a jack-up platform of the type operable to advantageously utilize the subject locking invention.
Figure 2:
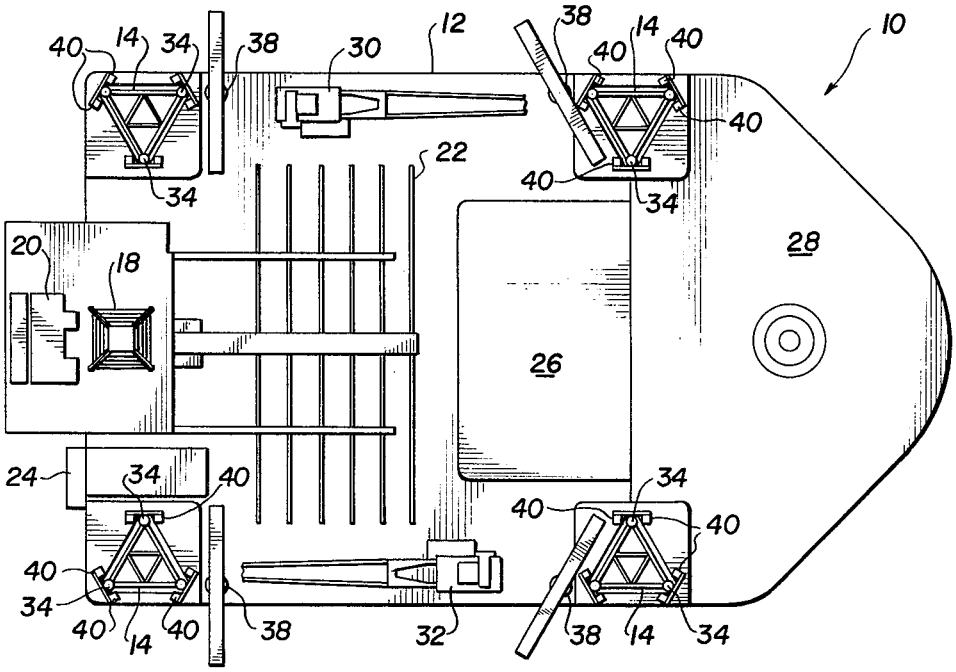
FIG. 2 is a plan view of the jack-up platform depicted in FIG. 1 including the disclosure of four jack-up legs having three chords each and a plurality of interconnecting bracing, wherein the platform legs are raised and lowered relative to the deck by the provision of a rack and pinion jacking units positioned at each of the leg chords.
Figure 3:
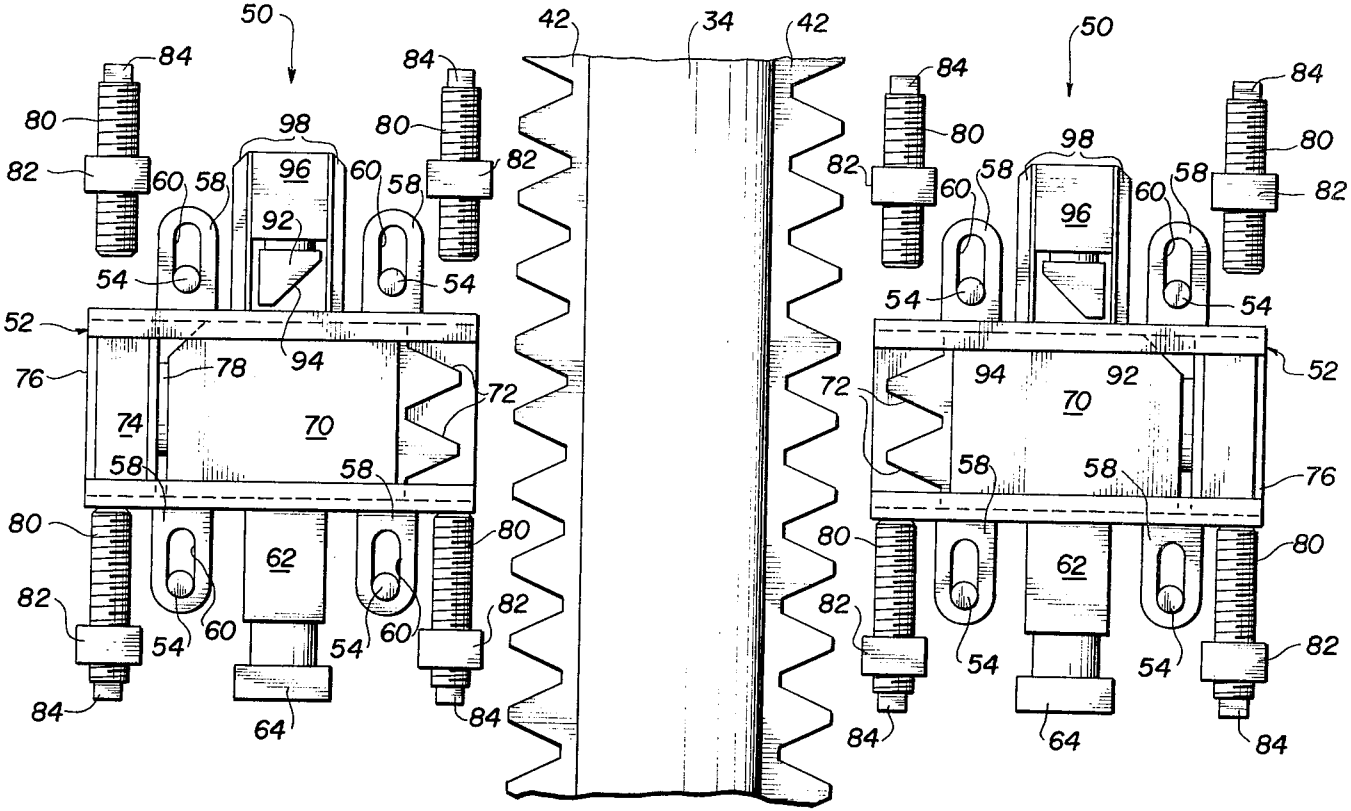
FIG. 3 is a detailed elevational view of a preferred embodiment of the subject locking mechanism in a disengaged posture.

Before presenting a detailed description of the subject jack-up platform locking apparatus, it may be worthwhile to briefly outline the context of the instant invention. In this connection FIGS. 1 and 2 depict an offshore jack-up platform 10 of the type which may advantageously utilize the locking mechanism of the subject invention.

The platform 10 comprises a self-propelled hull or deck 12 which serves to transport a plurality of platform legs 14 positioned within wells extending through the deck 12. On location the legs 14 are jacked downwardly into engagement with the bed of a body of water. Further jacking serves to raise the hull 12 above the surface of the body of water 16 to an elevation sufficient to minimize the tendency of the platform 12 from being contacted by the crest of a statistical storm wave.

The deck 12 is fitted with the usual accompaniment of offshore drilling and/or production equipment including a derrick 18, drawworks 20, piperacks 22, mud processing units 24, etc. The deck also is provided with crew quarters 26 and a heliport 28 as well as general purpose cranes 30 and 32. Each corner of the platform 12 is fitted with a vertical well extending through the hull which serves to guidingly receive one of the platform legs 14. Each of the platform legs comprises a plurality of generally vertically extending chords 34 which are structurally tied together and united by lateral bracing 36 which preferably is of the capital "K" or "X" configuration.

During transportation the legs 14 are carried substantially above the deck 12. Upon location the legs are jacked through the wells and into supporting contact with the seabed as previously described. Leg segments, not shown, may be optionally carried upon the deck during transportation and are lifted onto and aligned with the upper end of the leg segments 14 through the provision of a plurality of king posts 38.

The platform jacking operation may be achieved by a number of different techniques which are well known in the art. One form of jacking mechanism for which the subject invention is particularly useful is that known as a rack and pinion jacking or elevating mechanism. In this connection pinion gears 40 extend upon opposite sides of each of the chords 34 and matingly engage with a longitudinally extending rack which is fixedly connected to diametrically opposed surface of each of the chords. In operation the pinion gears are rotated through hydraulic or electric drive mechanisms mounted on or within the deck and wherein rotation of the pinion in one direction will serve to extend the legs relative to the deck 12 while rotation of the pinion in an opposite direction will serve to retract the legs 14 relative to the deck.

LOCKING APPARATUS

Turning now to the remaining drawings viz. FIGS. 3–6, there will be seen a single chord 34 of one of the platform legs 14. A rack 42 extends longitudinally along and is fixedly connected to each side of the chord 34.

The subject invention is directed to a locking mechanism 50 which is designed to selectively engage with teeth of the rack 42 and effectively lock the deck and legs together in a manner which will be discussed in detail herein presently.

Figure 4:
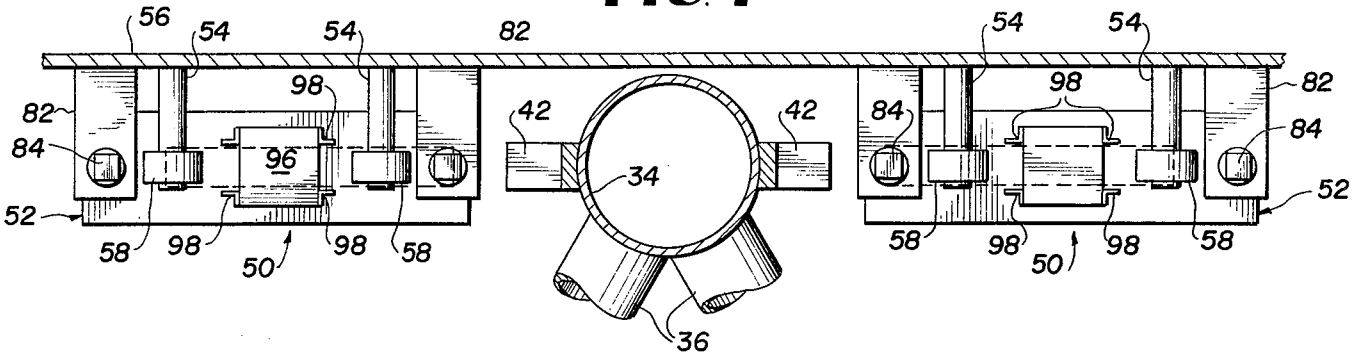
FIG. 4 is a plan view of the subject locking apparatus as depicted in FIG. 3 in a disengaged posture.

Each of the jack-up platform lock assemblies 50 includes a frame 52 which is vertically adjustable and guided by pins 54 which are fixedly mounted upon a section 56 of the deck, note FIGS. 4 and 6. Further in this regard, the frame 52 is provided with vertical adjustment guide loops 58 having an elongate aperture 60 which compatibly receive the free end of alignment of rods 54.

Vertical actuation of the frame 52 is achieved by at least one hydraulic motor 62 comprising a typical piston and cylinder combination wherein one end of the motor is operably connected to the deck via a connecting bar 64. The other end of the motor 62 is connected to the frame such that vertical raising and lowering of the somewhat heavy locking mechanism may be facilely and reliably achieved.

The frame 52 serves to carry a locking member 70 such as a chock having teeth 72 operable for engagement with the teeth of the rack 42. The exact spacing and depth of the teeth are selected such that upon full engagement of the chock as depicted in FIG. 5 the lands of the chock and rack teeth do not engage with the tips of the teeth and the sloping side surfaces thereof mutually interfere to provide a firm supporting connection.

Actuation of the chock toward and away from the rack 42 is achieved by a second hydraulic motor assembly 74 which is mounted at one end 76 upon an outer most portion of the frame 52 and at the inner end 78 upon a back surface of the chock 70. As depicted in FIGS. 5 and 6 it will be seen that actuation of the second motor 74 serves to drive the chock 70 into firm engagement with the rack 42.

The vertical position of the frame 52 is advantageously assured throughout the operating life of the lock by the provision of a plurality of mechanical securing or holding members 80, note particularly FIG. 5. The securing members 80 are threaded through holding arms 82 fixedly connected to the deck. These mechanical securing or locking members 80 include an upper end portion 84 containing wrench flats or the like designed to cooperate with an appropriate accuating tool. Upon locking of the frame 52 in vertical position with the lock screws 80 hydraulic pressure on the motor 64 may be relieved as desired.

The chock 70 is horizontally secured in operative position by the provision of a securing or locking wedge assembly. In this regard a wedge 92 having a sloping surface 94 is vertically actuated by a hydraulic motor assembly 96. The motor 96 is connected to the frame 52 through channel irons 98. A back portion of the chock or locking member 70 is fashioned with a sloping surface 100 designed to cooperate and engage with the wedge 92. Upon actuation of the motor 96 the wedge cooperates with the sloping surface of the chock to lock the chock into engagement with the rack and resist the tendency of axial forces on the leg to push the chock 70 laterally out of engagement with the rack. While the motor 96 is disclosed as being hydraulic it will be appreciated that a mechanical actuation assembly may be substituted by one of ordinary skill in the art.

In operation the platform is jacked to its desired elevation through the actuation of a pinion drive assemblies engaging the racks 42. Upon achieving the desired elevation and placement of the chord 34 in a general posture relative to the locking assemblies 50 such that horizontal loading will be directed through the horizontal bracing junctions of the 14 chock 70 is vertically adjusted through the provision of the hydraulic motor 62 until the teeth 72 of the chock are in alignment with the teeth in the rack 42. The actuating motor 74 then drives the chock teeth 72 into firm and supporting engagement with the rack. This position is mechanically secured actuation of the locking members 80. The motor 62 may then be relieved of pressure or maintained in a pressurized posture as desired. Horizontal engagement of the chock 70 with the rack 42 is secured by downward actuation of the wedge 92 which bears against a sloping surface of the chock and provides a resultant horizontal force which will prevent the chock 70 from becoming disengaged from the rack 42.

SUMMARY OF MAJOR ADVANTAGES OF THE INVENTION

After reading and understanding the foregoing description of the invention, in conjunction with the drawings, it will be appreciated that several advantages of the subject jack-up platform locking apparatus are obtained.

Without attempting to set forth all of these desirable features of the instant locking assembly, at least some of the major advantages of the invention include the provision of a lock which will secure the jack-up leg chords with respect to the deck through bracing junctions and will react bending moments occasioned upon the legs and deck from environmental sources without damaging the leg chords.

The vertical adjustment feature of the subject locking mechanism insures accurate and complete alignment of the chock and rack teeth to facilitate full engagement of the locking mechanism.

Lateral hydraulic actuation of the chock provides a first driving force which serves to securely position the chock in engagement and the chock frame is held in a fixed position for long term operation by the provision of mechanical lock members.

Horizontal engagement of the chock is maintained by the securing wedge 92 which drives against a compatible surface on the chock and maintains the chock teeth in full engagement with the rack while reacting any couple created on the chock by the force of the rack teeth.

In describing the invention, reference has been made to a preferred embodiment and illustrative advantages of the invention. Those skilled in the art, however, and familiar with the instant disclosure of the subject invention, may recognize additions, deletions, modifications, substitutions and/or other changes which will fall within the purview of the subject invention and claims.

What is claimed is:

1. A jack-up platform locking apparatus for at least partially securing a vertically adjustable leg of an offshore platform with respect to a deck of the platform, said locking apparatus comprising:

frame means operable to be securely connected to the deck of the offshore platform;

lock means having at least one tooth for engaging a compatibly configured surface on the vertically adjustable leg of the offshore platform;

means for vertically adjusting said lock means with respect to said deck and said leg;

means for horizontally actuating or deactivating said lock means with respect to said leg for engaging and disengaging said at least one tooth with respect to the compatibly configured surface on said vertically adjustable leg;

means for vertically securing said lock means with respect to said deck and said leg; and means for horizontally securing said lock means with respect to said deck and said leg.

2. A jack-up platform locking apparatus as defined in claim 1 wherein said means for vertically adjusting said locking means comprises:

hydraulic motor means operably positioned between said deck and said lock means to vertically raise or lower said lock means to facilitate compatible engagement of said at least one tooth with said compatibly configured surface on said leg of the offshore platform.

3. A jack-up platform locking apparatus as defined in claim 1 wherein means for horizontally engaging and disengaging said at least one tooth comprises:

hydraulic motor means operably positioned between said frame means and said lock means for advancing or retracting said at least one tooth of said lock means with respect to said compatibly configured surface on said leg of the offshore platform.

4. A jack-up platform locking apparatus as defined in claim 1 wherein said means for vertically securing comprises:

threaded mechanical securing means operably connected between said deck and said lock means for mechanically setting in vertical position said lock means with respect to said leg.

5. A jack-up platform locking apparatus as defined in claim 1 wherein said means for horizontally securing comprises:

wedge means operably positionable between said frame means and said lock means.

6. A jack-up platform locking apparatus as defined in claim 5 and further comprising:

hydraulic motor means operably connected to said frame means for advancing or retracting said wedge means into or out of engagement with said lock means.

7. A jack-up platform locking apparatus as defined in claim 1 wherein said leg of the offshore platform is vertically adjustable with respect to the platform through the provision of a rack longitudinally extending along said leg and a pinion and motor drive secured to said deck, wherein said lock means comprises:

a chock having at least a pair of teeth for engaging the rack of said leg, said chock being carried by and horizontally guided for translation within said frame means.

8. A jack-up platform locking apparatus as defined in claim 7 wherein:

said means for vertically adjusting comprises at least one hydraulic motor means operably connected between said frame means and said chock; and said means for horizontally actuating comprises at least one hydraulic motor means operably connected between said frame means and said chock.

9. A jack-up platform locking apparatus as defined in claim 8 wherein said means for vertically securing comprises:

locking screw means operably secured to said deck and operably abutting against said chock.

10. A jack-up platform locking apparatus as defined in claim 9 wherein said means for horizontally securing said lock means comprises:

wedge means operably positionable between said frame means and said chock means.

11. A jack-up platform locking apparatus as defined in claim 10 and further comprising:

hydraulic motor means operably connected to said frame means for advancing or retracting said wedge means into or out of engagement with a sloping surface on the back side of said chock means.

* * * * *